US005110490A

United States Patent [19]

Pink et al.

[11] Patent Number: 5,110,490

[45] Date of Patent: May 5, 1992

[54] WATER RESISTANT GREASE COMPOSITION

[75] Inventors: Harry S. Pink, Whitehouse Station, N.J.; Timothy Hutchings, Grove, England; James F. Stadler, Bethel Park, Pa.

[73] Assignee: Exxon Research and Engineering Company, Florham Park, N.J.

[21] Appl. No.: 372,409

[22] Filed: Jun. 27, 1989

[51] Int. Cl.[5] ..... C10M 149/06

[52] U.S. Cl. ..... 252/35; 252/38; 252/51.5 A

[58] Field of Search ..... 252/17, 51.5 A, 35, 252/38

[56] References Cited

U.S. PATENT DOCUMENTS

| | | | |
|---|---|---|---|
| 2,991,249 | 7/1961 | Andress, Jr. et al. | 252/40 |
| 3,189,543 | 6/1965 | Criddle | 252/18 |
| 3,592,117 | 7/1968 | Glasson | 252/17 |
| 3,891,506 | 4/1974 | Cross et al. | 252/40 |
| 4,517,104 | 5/1985 | Blach et al. | 252/51.5 A |
| 4,664,676 | 5/1987 | Denis et al. | 44/62 |
| 4,676,914 | 6/1987 | Sung et al. | 252/51.5 A |
| 4,720,350 | 1/1988 | Zoleski | 252/51.5 A |
| 4,731,095 | 5/1988 | Garapon et al. | 44/62 |
| 4,749,500 | 6/1958 | Forsberg et al. | 252/49.3 |
| 4,803,003 | 2/1989 | Chung | 252/51.5 A |

FOREIGN PATENT DOCUMENTS

| | | |
|---|---|---|
| 3508978 | 7/1978 | Australia . |
| 0338672 | 10/1979 | European Pat. Off. . |
| 0146162 | 6/1985 | European Pat. Off. . |
| 2145563 | 2/1973 | France . |

OTHER PUBLICATIONS

Swalheet et al., Lubricant Additives, pp. 1-11, 1967.

93:207162-Study of the properties of lithium greases containing copolymers of ethylene w/vinyl acetate & diethylaminoethyl methacrylate-Moscow, USSR-1980, (5), 22-4.

*Primary Examiner*—Prince Willis, Jr.
*Assistant Examiner*—Ellen M. McAvoy
*Attorney, Agent, or Firm*—John W. Ditsler

[57] ABSTRACT

A grease composition having improved water resistance is disclosed. More specifically, the addition of an ethylene copolymer having an amine functionality to a base grease comprising a lubricating oil and a water insoluble thickener results in a grease composition which has enhanced water resistance relative to a grease containing an ethylene copolymer without amine functionality.

31 Claims, No Drawings

WATER RESISTANT GREASE COMPOSITION

CROSS-REFERENCE TO RELATED APPLICATIONS

This application is related to a copending application entitled "Water Resistant Grease Composition", filed on the same date herewith, that has an attorney docket number of PNE-552.

BACKGROUND OF THE INVENTION

1. Field of the Invention

This invention relates to a grease composition having improved water resistance.

2. Description of Related Art

The use of polymers to impart desirable properties to greases is known and widely practiced by grease manufacturers (see E.N. Klemgard, *Lubricating Greases* (1937) and C. J. Boner, *Manufacture and Application of Lubricating Greases* (1954)). For example, oil soluble polymers have been used to increase the viscosity of the lubricating oil in the grease, thereby resulting in a grease having enhanced structural stability, reduced oil separation, and increased water resistance. However, although these benefits could be obtained without polymers using lubricating oils having high viscosity basestocks, the resulting debit on low temperature mobility (i.e. pumpability) severely limits a non-polymer approach.

In addition, a recent publication (see G.D. Hussey, "Alternation of Grease Characteristics with New Generation Polymers", NLGI Spokesman, August 1987) compared the performance of commonly used polymers in various greases. However, none of the compositions mentioned in these references teach or suggest the water resistance grease composition described hereinafter.

SUMMARY OF THE INVENTION

This invention concerns a grease composition having improved water resistance due to the addition of a particular oil soluble ethylene copolymer. More specifically, a grease composition comprising (1) a lubricating oil, (2) a water insoluble thickener, and (3) an ethylene copolymer having an amine functionality has been found to have enhanced water resistance relative to that obtained if the copolymer did not have amine functionality. A further improvement in water resistance is obtained when lower molecular weight versions of the copolymer are used.

DETAILED DESCRIPTION OF THE INVENTION

The essential components of this invention are a lubricating oil, a water insoluble thickener, and an ethylene copolymer having amine functionality.

A wide variety of lubricating oils can be employed in preparing the grease composition of this invention. Accordingly, the lubricating oil base can be any of the conventionally used mineral oils, synthetic hydrocarbon oils, or synthetic ester oils. In general, these lubricating oils will have a viscosity in the range of about 5 to about 5,000 cSt at 40° C., although typical applications will require an oil having a viscosity ranging from about 25 to about 2,000 cSt at 40° C. Mineral lubricating oil base stocks used in preparing the lubricating composition can be any conventionally refined base stocks derived from paraffinic, naphthenic, and mixed base crudes. Synthetic lubricating oils that can be used include esters of dibasic acids such as di-2-ethylhexyl sebacate, esters of glycols such as a $C_{13}$ oxo acid diester of tetraethylene glycol, or complex esters such as the ester formed from 1 mole of sebacic acid, 2 moles of tetraethylene glycol, and 2 moles of 2-ethylhexanoic acid. Other synthetic oils that can be used include synthetic hydrocarbons such as polyalphaolefins; alkyl benzenes (e.g., alkylate bottoms from the alkylation of benzene with tetrapropylene, or the copolymers of ethylene and propylene silicon oils, e.g., ethyl phenyl polysiloxanes, methyl polysiloxanes, etc.); polyglycol oils (e.g., those obtained by condensing butyl alcohol with propylene oxide); and carbonate esters (e.g., the product of reacting $C_8$ oxo alcohol with ethyl carbonate to form a half ester followed by reaction of the latter with tetraethylene glycol, etc.). Other suitable synthetic oils include the polyphenyl ethers, e.g., those having from about 3 to 7 ether linkages and about 4 to 8 phenyl groups. (See U.S. Pat. No. 3,424,678, column 3.) Normally, the lubricating oil will comprise a major amount of the grease composition. Typically, the amount of lubricating oil will range from above about 50 to about 90 wt.%, preferably from about 70 to about 85 wt.%, of the grease composition.

The grease composition will also contain a thickener dispersed in the lubricating oil to form a base grease. However, the particular thickener employed is not critical and can vary broadly provided it is essentially water insoluble. For example, the thickener may be based on aluminum, barium, calcium, lithium soaps, or their complexes. Soap thickeners may be derived from a wide range of animal oils, vegetable oils, and greases as well as the fatty acids derived therefrom. These materials are well known in the art and are described in, for example, C.J. Boner, Manufacture and Application of Lubricating Greases, Chapter 4, Robert E. Krieger Publishing Company, Inc., New York (1971). Carbon black, silica, and clays may be used as well as dyes, polyureas, and other organic thickeners. Pyrrolidone based thickeners can also be used. Preferred thickeners are based on lithium soap, calcium soap, their complexes, or mixtures thereof. Particularly preferred is a lithium or lithium complex thickener that incorporates an hydroxy fatty acid having from 12 to 24 (preferably from 16 to 20) carbon atoms. A preferred hydroxy fatty acid is an hydroxy stearic acid (e.g., a 9-hydroxy or a 10-hydroxy stearic acid) of which 12-hydroxy stearic acid is most preferred (See U.S. Pat. No. 3,929,651, the disclosure of which is incorporated herein by reference). The amount of thickener in the lubricating composition will typically range from about 1 to about 15 wt.%. For most purposes, between about 6 to about 12 wt.%, preferably between about 8 to about 10 wt.%, of the thickener will be present in the composition.

The grease composition will also contain an ethylene copolymer having amine functionality. By "amine functionality" is meant the oil soluble ethylene copolymers described in U.S. Pat. No. 4,517,104, the disclosure of which is incorporated herein by reference. In general, these oil soluble ethylene copolymers will have a number average molecular weight ($\overline{M}_n$) of from about 5,000 to about 500,000; preferably from about 10,000 to about 300,000, and optimally from about 20,000 to about 175,000. These polymers will generally have a narrow range of molecular weight, as determined by the ratio of weight average molecular weight ($\overline{M}_w$) to number average molecular weight ($\overline{M}_n$). Polymers having a $\overline{M}_w/\overline{M}_n$ of less than 10, preferably less than 7, and more preferably 4 or less are most desirable. As used herein ($\overline{M}_n$) and ($\overline{M}_w$) are measured by the well known techniques of vapor phase osmometry (VPO), membrane osmometry, and gel permeation chromotography.

These polymers are prepared from ethylene and ethylenically unsaturated hydrocarbons including cyclic, alicyclic and acyclic, containing from 3 to 28 carbons, e.g. 2 to 18 carbons. The ethylene copolymers may contain from about 15 to about 90 wt.%, preferably from about 30 to about 80 wt.%, of ethylene and from about 10 to about 85 wt.%, preferably from about 20 to about 70 wt.%, of one or more $C_3$ to $C_{28}$, preferably $C_3$ to $C_{18}$, more preferbly $C_3$ to $C_8$, alpha olefins. While not essential, such copolymers preferably have a degree of crystallinity of less than 25 wt.%, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins such as 4-methyl-1-pentene, 4-methyl-1-hexene, 5-methyl-pentene-1, 4,4-dimethyl-1-pentene, and 6-methyl-heptene-1, etc., and mixtures thereof.

The term copolymer as used herein, unless otherwise indicated, includes terpolymers, tetrapolymers, etc., of ethylene, said $C_{3-28}$ alpha-olefin and/or a non-conjugated diolefin or mixtures of such diolefins which may also be used. The amount of the non-conjugated diolefin will generally range from about 0.5 to 20 mole percent, preferably about 1 to about 7 mole percent, based on the total amount of ethylene and alpha-olefin present.

Representative examples of non-conjugated dienes that may be used as the third monomer in the terpolymer include:

a. Straight chain acyclic dienes such as: 1,4-hexadiene; 1,5-heptadiene; 1,6-octadiene.

b. Branched chain acyclic dienes such as: 5-methyl-1,4-hexadiene; 3,7-dimethyl 1,6-octadiene; 3,7-dimethyl 1,7-octadiene; and the mixed isomers of dihydro-myrcene and dihydro-cymene.

c. Single ring alicyclic-dienes such as: 1,4-cyclohexadiene; 1,5-cyclooctadiene; 1,5-cyclododecadiene; 4-vinylcyclohexene; 1-allyl, 4-isopropylidene cyclohexane; 3-allyl-cyclopentene; 4-allyl cyclohexene and 1-isopropenyl-4-(4-butenyl)-cyclohexane.

d. Multi-single ring alicyclic dienes such as: 4,4'-dicyclopentenyl and 4,4,-dicyclohexenyl dienes.

e. Multi-ring alicyclic fused and bridged ring dienes such as: tetrahydroindene; methyl tetrahydroindene; dicyclopentadiene; bicyclo(2.2.1)-hepta 2,5-diene; alkyl, alkenyl, alkylidene, cycloalkenyl alkenyl and cycloalkylidene norbornenes such as: ethyl norbornene; 5-methylene-6-methyl-2-norbornene; 5-methylene-6, 6-dimethyl-2-norbornene; 5-propenyl-2-norbornene 5-(3-cyclopentenyl)-2-norbornene and 5-cyclohexylidene-2-norbornene; norbornadiene; etc.

Ethylenically unsaturated carboxylic acid materials which are grafted (attached) onto the ethylene copolymer contain at least one ethylenic bond and at least one, preferably two, carboxylic acid groups, or an anhydride group, or a polar group which can be converted into said carboxyl groups by oxidation or hydrolysis. Maleic anhydride or a derivative thereof is preferred because it does not appear to homopolymerize appreciably but grafts onto the ethylene copolymer to give two carboxylic acid functionalities. Such preferred materials have the general formula

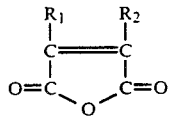

wherein $R_1$ and $R_2$ are hydrogen or a halogen. Suitable examples additionally include chloro-maleic anhydride, itaconic anhydride, or the corresponding dicarboxylic acids, such as maleic acid or fumaric acid or their monoesters, etc.

As taught by U.S. Pat. Nos. 4,160,739 and 4,161,452, various unsaturated comonomers may be grafted on the olefin copolymer together with the unsaturated acid component, e.g. maleic anhydride. Such graft monomer systems may comprise one or a mixture of comonomers different from the unsaturated acid component and which contain only one copolymerizable double bond and are copolymerizable with said unsaturated acid component. Typically, such comonomers do not contain free carboxylic acid groups and are esters containing $\alpha,\beta$-ethylenic unsaturation in the acid or alcohol portion; hydrocarbons, both aliphatic and aromatic, containing $\alpha,\beta$-ethylenic unsaturation, such as the $C_4$–$C_{12}$ alpha olefins, for example isobutylene, hexene, nonene, dodecene, etc.; styrenes, for example styrene, $\alpha$-methyl styrene, p-methyl styrene, p-sec. butyl styrene, etc.; and vinyl monomers, for example vinyl acetate, vinyl chloride, vinyl ketones such as methyl and ethyl vinyl ketone, etc. Comonomers containing functional groups which may cause crosslinking, gelation or other interfering reactions should be avoided, although minor amounts of such comonomers (up to about 10% by weight of the comonomer system) often can be tolerated.

Specific useful copolymerizable comonomers include the following:

(A) Esters of saturated acids and unsaturated alcohols wherein the saturated acids may be monobasic or polybasic acids containing up to about 40 carbon atoms such as the following: acetic, propionic, butyric, valeric, caproic, stearic, oxalic, malonic, succinic, glutaric, adipic, pimelic, suberic, azelaic, sebacic, phthalic, isophthalic, terephthalic, hemimellitic, trimellitic, trimesic and the like, including mixtures. The unsaturated alcohols may be monohydroxy or polyhydroxy alcohols and may contain up to about 40 carbon atoms, such as the following: allyl, methally, crotyl, 1-chloroallyl, 2-chloroallyl, cinnamyl, vinyl, methyl vinyl, 1-phenallyl, butenyl, propargyl, 1-cyclohexene-3-ol, oleyl, and the like, including mixtures.

(B) Esters of unsaturated monocarboxylic acids containing up to about 12 carbon atoms such as acrylic, methacrylic and crotonic acid, and an esterifying agent containing up to about 50 carbon atoms, selected from saturated alcohols and alcohol epoxides. The satuarted alcohols may preferably contain up to about 40 carbon atoms and include monohydroxy compounds such as: methanol, ethanol, propanol, butanol, 2-ethylhexanol, octanol, dodecanol, cyclohexanol, cyclopentanol, neopentyl alcohol, and benzyl alcohol; and alcohol ethers such as the monomethyl or monobutyl ethers of ethylene or propylene glycol, and the like, including mixtures. The alcohol epoxides include fatty alcohol epoxides, glycidol, and various derivatives of alkylene oxides, epichlorohydrin, and the like, including mixtures.

The components of the graft copolymerizable system are used in a ratio of unsaturated acid monomer component to comonomer component of about 1:4 to 4:1, preferably about 1:2 to 2:1 by weight.

The grafting of the ethylene copolymer with the carboxylic acid material may be by any suitable method, such as thermally by the "ene" reaction, using copolymers containing unsaturation, such as ethylene-propylene-diene polymers either chlorinated or unchlorinated, or more preferably it is by free-radical induced grafting in solvent, preferably in a mineral lubricating oil as solvent.

The radical grafting is preferably carried out using free radical initiators such as peroxides, hydroperoxides, and azo compounds and preferably those which have a boiling point greater than about 100° C. and which decompose thermally within the grafting temperature range to provide said free radicals. Representative of these free-radical initiators are azobutyro-nitrile, 2,5-dimethyl-hex-3-yne-2, 5 bis-tertiary-butyl peroxide (sold as Lupersol 130) or its hexane analogue, di-tertiary butyl peroxide and dicumyl peroxide. The initiator is generally used at a level of between about 0.005% and about 1%, based on the total weight of the polymer solution, and temperatures of about 150° to 220° C.

The ethylenically unsaturated carboxylic acid material, preferably maleic anhydride, will be generally used in an amount ranging from about 0.01% to about 10%, preferably 0.1 to 2.0%, based on weight of the initial total solution. The aforesaid carboxylic acid material and free radical initiator are generally used in a weight percent ratio range of 1:1 to 30:1, preferably 3:1 to 6:1.

The amine component will have two or more primary amine groups, wherein the primary amine groups may be unreacted, or wherein one of the amine groups may already be reacted.

Particularly preferred amine compounds have the following formulas:

(A) alkylene polyamines

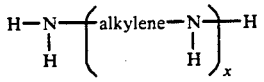

wherein x is an integer of about 1 to 10, preferably about 2 to 7, and the alkylene radical is a straight or branched chain alkylene radical having 2 to 7, preferably about 2 to 4, carbon atoms;

(B) polyoxyalkylene polyamines $$NH_2\text{—alkylene}\text{-}(\text{O—alkylene})_m NH_2 \quad \text{(i)}$$

where m has a value of about 3 to 70, preferably 10 to 35; and $$R\text{-}(\text{alkylene}\text{-}(\text{O—alkylene})_n NH_2)_{3-6} \quad \text{(ii)}$$

where n has a value of about 1 to 40 with the provision that the sum of all the n's is from about 3 to about 70, preferably from about 6 to about 35, and R is a polyvalent saturated hydrocarbon radical of up to ten carbon atoms having a valence of 3 to 6. The alkylene groups in either formula (i) or (ii) may be straight or branched chains containing about 2 to 7, preferably about 2 to 4, carbon atoms.

Examples of the alkylene polyamines of formula (A) above include methylene amines, ethylene amines, butylene amines, propylene amines, pentylene amines, hexylene amines, heptylene amines, octylene amines, other polymethylene amines, the cyclic and higher homologs of these amines such as the piperazines, the amino-alkyl-substituted piperazines, etc. These amines include, for example, ethylene diamine, diethylene triamine, triethylene tetramine, propylene diamine, di(-heptamethylene)triamine, tripropylene tetramine, tetraethylene pentamine , trimethylene diamine, pentaethylene hexamine, di(trimethylene)triamine, 2-heptyl-3-(2-aminopropyl)imidazoline, 4-methylimidazoline, 1,3-bis(2-aminoethyl)imidazoline, pyrimidine, 1-(2-aminopropyl)piperazine, 1,4-bis-(2-aminoethyl)piperazine, N,N-dimethyaminopropyl amine, N,N-dioctylethyl amine, N-octyl-N'-methylethylene diamine, 2-methyl-1-(3-aminobutyl)-piperazine, piperazine, etc. Other higher homologs which may be used can be obtained by condensing two or more of the above-mentioned alkylene amines in a known manner.

The ethylene amines which are particularly useful are described, for example, in the Encyclopedia of Chemical Technology under the heading of "Ethylene Amines" (Kirk and Othmer), Volume 5, pgs. 898–905; Interscience Publishers, New York (1950).

The polyoxyalkylene polyamines of formula (B) above, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for examples, from the Jefferson Chemical Company, Inc. under the trade name "Jeffamines D-230, D-400, D-1000, D-2000, T-403", etc.

The acid component includes: hydrocarbyl substituted succinic anhydride or acid having 12 to 49 carbons, preferably 16 to 49 carbons in said hydrocarbyl group; long chain monocarboxylic acid of the formula RCOOH where R is a hydrocarbyl group of 50 to 400 carbons and long chain hydrocarbyl substituted succinic anhydride or acid having 50 to 400 carbons in said hydrocarbyl group. Said hydrocarbyl groups are essentially aliphatic and include alkenyl and alkyl groups. The longer chain acids and anhydrides are preferred, particularly when the grafting reaction is carried out in lubricating oil because of its ability to impart dispersancy to reacted oil molecules as well as their greater solubilizing effect.

Primarily because of its ready availability and low cost, the hydrocarbyl portion (e.g. alkenyl groups) of the carboxylic acid or anhydride is preferably derived from a polymer of a $C_2$ to $C_5$ monoolefin, said polymer generally having a molecular weight of about 140 to 6500, e.g. 700 to about 5000, most preferably 700 to 3000 molecular weight. Particularly preferred is polyisobutylene.

The aforesaid amine and acid component may be prereacted, with the acid being generally attached to the amine through salt, imide, amide, amidine, ester, or other linkages so that a primary amine group of the polyamine is still available for reaction with the acid moieties of the grafted polymer.

The amount of the ethylene copolymer containing amine functionality in the grease composition need only be that which improves the water resistance of the grease. Typically, however, the amount of copolymer will range from about 0.01 to about 4 wt.%, preferably from about 0.1 to about 2 wt.%, based on weight of the grease, although larger amounts could be used if desired.

The particular copolymer employed in this invention can be readily obtained in the marketplace. As such, its methods of preparation is well known to those skilled in the art (see U.S. Pat. No. 4,517,104).

The grease composition may also contain small amounts of supplemental additives which include, but are not limited to, anticorrosive agents, extreme pressure antiwear agents, pour point depressants, tackiness agents, oxidation inhibitors, dyes, and the like, which are incorporated for specific purposes. The total amount of these additives will typically range from about 2 to about 5 wt.% based on total weight of the grease composition. In addition, solid lubricants such as molybdenum disulfide and graphite may be present in the composition—typically from about 1 to about 5 wt.% (preferably from about 1.5 to about 3 wt.%) for molybdenum disulfide and from about 3 to about 15 wt.% (preferably from about 6 to about 12 wt.%) for graphite.

The grease composition of this invention is usually prepared in situ by chemically reacting or mechanically dispersing thickener components in the lubricating oil for from about 1 to about 8 hours or more (preferably from about 3 to about 6 hours) followed by heating at elevated temperature (e.g., from about 140° to about 225° C. depending upon the particular thickener used) until the mixture thickens. In some cases (e.g. a simple lithium grease), a preformed thickener can be used. The mixture is then cooled to ambient temperature (typically about 60° C.) during which time the ethylene copolymer and other additives are added. The polymer and the other additives can be added together or separately in any order.

The components of the grease composition can be mixed, blended, or milled in any number of ways which can readily be selected by one skilled in the art. Suitable means include external mixers, roll mills, internal mixers, Banbury mixers, screw extruders, augers, colloid mills, homogenizers, and the like.

The grease composition of this invention may be suitably employed in essentially any application requiring good water resistance. Examples of such applications include steel mills, underground mining, and the like. The composition, however, is particularly well suited for use in steel mill applications.

This invention will be further understood by reference to the following examples which are not intended to restrict the scope of the claims appended hereto.

EXAMPLE 1

Water Spray-Off of a Lithium Grease Without Ethylene-Propylene Copolymer

A base grease was prepared in a commercial gas-fired grease kettle from the following ingredients:

| Ingredients | Weight (kg.) per 1000 kg. of Base Grease |
|---|---|
| 1200 Coastal Pale | 897.4 |
| Lithium Hydroxide Monohydrate | 12.6 |
| Fatty Acid | 90.0 |

The fatty acid (which contains about 96.5 wt.% 12-hydroxy stearic acid) was dissolved in approximately 50% of the 1200 Coastal Pale (a naphthenic oil having a viscosity of 229 cSt at 40° C.) followed by neutralization of the resulting product with lithium hydroxide monohydrate previously dispersed in water (in the ratio of 0.4 kg. to 1 kg. of water). The mixture was heated to approximately 110° C., adjusted to an alkalinity equivalent to 0.05 to 0.15 wt% NaOH, and further heated to about 196° C. The remainder of the oil was added, and the product cooled to ambient temperature, filtered, and homogenized in a colloid mill to form the base grease.

A diluent oil of 105 Coastal Pale (a naphthenic oil having a viscosity of 21 cSt at 40° C.) was added to the base grease and blended in a Hobart mixer until the resulting grease (Grease A) had an NLGI No. 1 consistency (310-340 dmm. penetration X60).

The water spray-off (a measure of water resistance) of Grease A was determined using ASTM D 4049 "Resistance of Lubricating Grease to Water Spray" (the disclosure of which is incorporated herein by reference), in which a steel panel was coated with a 1/32 inch layer of grease and then sprayed with water controlled to 38°±0.5° C. and 276 kPa. At the end of about 5 minutes, the amount of grease removed was determined, and spray-off reported as a percentage of the original amount applied. The results obtained for Grease A are shown in Table 1 below.

EXAMPLE 2

Water Spray-Off of a Lithium Grease Containing Ethylene-Propylene Copolymer Without Amine Functionality Two polymer-containing blends (Greases B and C) were then prepared by adding different amounts of the same ethylene-propylene copolymer to the base grease prepared above. The copolymer was obtained as a commercial viscosity index improver in solution with Solvent 100 Neutral and then further diluted with 105 Coastal Pale for ease of handling. The base grease, polymer, and diluent oil were blended for 30 min. in a Hobart mixer to produce greases having an NLGI No. 1 consistency. The water spray-off of Greases B and C were then determined using ASTM D 4049 and the results obtained summarized in Table 1 below.

EXAMPLE 3

Water Spray-Off of a Lithium Grease Containing Ethylene-Propylene Copolymer With Amine Functionality Example 2 was repeated for several blends that contained a high molecular weight analog of an ethylene-propylene copolymer containing amine functionality (Greases D-H).

Although molecular weight can be established by a variety of techniques known in the art, the molecular weight of copolymers used as lubricant additives can be established by reference to their "Shear Stability Index" (or "SSI"). SSI measures the relative change in polymer viscosity due to mechanical shearing in a standard engine test (L-38 10 Hr. Test), and ranges from 0% for a low molecular weight copolymer to 22% or more for a high molecular weight copolymer.

As in Example 2, the copolymer was obtained as a viscosity index improver in Solvent 100 Neutral LP and further diluted with 105 Coastal Pale for ease of handling. The copolymer had an ethylene content of about 44 wt.%, an SSI of 22%, and a weight average molecular weight estimated to range from about 140,000 to about 150,000. Aliquots of the copolymer solution were blended with the base grease of Example 1 using a Hobart mixer to prepare greases having an NLGI No. 1 consistency. Copolymer concentrations ranged from 0.28 to 1.65 wt%. Water spray-off of Greases D–H was measured as in Example 1 and the results obtained summarized in Table 1 below.

EXAMPLE 4

Water Spray-Off of a Grease Containing a Low MW Ethylene-Propylene Copolymer With Amine Functionality Example 3 was repeated using a low molecular weight analog of an ethylene-propylene copolymer with amine functionality (Greases I–L). The copolymer had an ethylene content of about 44 wt.%, an SSI of zero, and a weight average molecular weight estimated to be about 110,000. Copolymer concentrations ranged from 0.93 to 1.86 wt%. The water spray-off of Greases I–L were measured as in Example 1 and the results obtained summarized in Table 1 below.

TABLE 1

| Grease (1) | Copolymer | Concentration, wt % | Water Spray-off, wt % Loss |
|---|---|---|---|
| A | None | 0.00 | 99 |
| B | Ethylene-Propylene | 0.28 | 90 |
| C | Ethylene-Propylene | 0.68 | 70 |
| D | Ethylene-Propylene w. Amine Functionality High Molecular Wt. (SSI = 22%) | 0.28 | 79 |
| E | Ethylene-Propylene w. Amine Functionality High Molecular Wt. (SSI = 22%) | 0.38 | 58 |
| F | Ethylene-Propylene w. Amine Functionality High Molecular Wt. (SSI = 22%) | 0.56 | 50 |
| G | Ethylene-Propylene w. Amine Functionality High Molecular Wt. (SSI = 22%) | 1.11 | 42 |
| H | Ethylene-Propylene w. Amine Functionality High Molecular Wt. (SSI = 22%) | 1.65 | 45 |
| I | Ethylene-Propylene w. Amine Functionality Low Molecular Wt. (SSI = 0%) | 0.93 | 62 |
| J | Ethylene-Propylene w. Amine Functionality Low Molecular Wt. (SSI = 0%) | 1.17 | 47 |
| K | Ethylene-Propylene w. Amine Functionality Low Molecular Wt. (SSI = 0%) | 1.40 | 26 |
| L | Ethylene-Propylene w. Amine Functionality Low Molecular Wt. (SSI = 0%) | 1.86 | 30 |

(1) Each grease had an NLGI No. 1 consistency.

A comparison of Greases A–C in Table 1 shows that water spray-off is reduced (and water resistance is increased) when the grease contains an ethylene-propylene copolymer.

A comparison of Greases D–L with Greases B–C shows that a further reduction in water spray-off is obtained at the same copolymer concentrations when an ethylene-propylene copolymer with amine functionality is used.

A comparison of Greases D–H with Greases I–L shows that a still greater reduction in water spray-off is obtained when a low molecular weight analog of the ethylene-propylene copolymer with amine functionality is used. This may be seen by comparing the water spray-off at the copolymer concentration of maximum effectiveness for the high and low molecular weight analogs. By "copolymer concentration of maximum effectiveness" is meant the copolymer concentration beyond which there is essentially no further improvement in water spray-off with copolymer addition. Thus, the "copolymer concentration of maximum effectiveness" is about 1.1 wt.% for the high molecular weight analog and about 1.4 wt.% for the low molecular weight analog. Accordingly, the minimum spray-off achieved is about 42 wt.% for the high molecular weight analog (Greases G and H) and about 26 wt.% for the low molecular weight analog (Greases K and L), considering that the repeatability of ASTM D 4049 is ±6 wt.%.

EXAMPLE 5

Water Spray-Off of a Lithium Complex Grease Containing an Ethylene-Propylene Copolymer With Amine Functionality A lithium complex grease was prepared in a laboratory gas-fired grease kettle using the following ingredients:

| Ingredients | wt. % |
|---|---|
| 100 cSt Naphthenic Oil (1) | 30.8 |
| 113 cSt Paraffinic Oil (1) | 21.1 |
| 500 cSt Paraffinic Oil (1) | 31.0 |
| Lithium Hydroxide Monohydrate | 2.8 |
| 12-Hydroxy Stearic Acid | 5.7 |
| Azelaic Acid | 4.4 |
| Other Additives | 4.2 |

(1) Viscosity at 40° C.

(1) Viscosity at 40° C.

The grease was prepared by charging a gas-fired laboratory kettle with about 70% of the oil, adding the fatty acids and heating to about 82° C. to dissolve the components. The acids were neutralized with an aqueous dispersion of the alkali, and saponification completed by heating the reaction mixture to a temperature of about 200° C. After cooling the contents to about 93° C., other additives (antiwear, antioxidant, and anticorrosion agents) were added, and the grease milled. The finished grease had a penetration (60X) of 330 dmm.

Examples 3 and 4 were repeated using the formulated lithium complex grease prepared above and ethylene-propylene copolymers of high and low molecular weight (SSI=22% and 0%, respectively). Water spray-off was determined as in the previous examples and the results obtained summarized in Table 2 below.

TABLE 2

| Grease (1) | Copolymer | Concentration, wt % | Water Spray-off, wt % Loss |
|---|---|---|---|
| M | None | — | 98 |
| N | Ethylene-Propylene w. Amine Functionality (SSI = 22%) | 0.56 | 34 |
| O | Ethylene Propylene w. Amine Functionality (SSI = 0%) | 1.40 | 22 |

(1) Each grease had an NLGI No. 1 consistency.

The data in Table 2 show that Grease M with no copolymer had little resistance to water spray-off, whereas Greases N and 0 showed significantly greater resistance.

What is claimed is:

1. A grease composition which comprises
(a) from about 50 to about 90 wt.% of a lubricating oil,
(b) from about 1 to about 15 wt.% of a water insoluble thickener, and
(c) from about 0.01 to about 4 wt.% of a copolymer that comprises the reaction product of
(i) an ethylene copolymer comprising from about 15 to about 90 wt.% ethylene and from about 10 to about 85 wt.% of one or more $C_3$ to $C_{28}$ alpha-olefin wherein the copolymer has a number average molecular weight ranging from about 5,000 to about 500,000 and is grafted with an ethylenically unsaturated carboxylic acid material containing at least one ethylenic bond and at least one carboxylic acid groups or anhydride groups;
(ii) an alkylene or oxyalkylene amine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups will be about 3 to 70; and,
(iii) a long chain hydrocarbyl substituted succinic anhydride or acid having 50 to 400 carbon atoms.

2. The composition of claim 1 wherein the thickener is based on aluminum, barium, calcium, lithium soaps, or their complexes.

3. The composition of claim 2 wherein the thickener is based on a lithium soap, a calcium soap, their complexes, or mixtures thereof.

4. The composition of claim 2 wherein the alpha olefin contains a $C_3$ to $C_8$ alpha olefin.

5. The composition of claim 4 wherein the reaction product is formed by simultaneously reacting (i), (ii), and (iii) with removal of water.

6. The composition of claim 5 wherein (ii) and (iii) are first pre-reacted followed by reaction with (i).

7. The composition of claim 5 wherein (i) comprises a copolymer containing from about 30 to about 80 wt.% ethylene and from about 20 to about 70 wt.% propylene, having a number average molecular weight in the range of about 10,000 to 200,000 grafted with maleic anhydride.

8. The composition of claim 7 wherein (i) comprises ethylene and propylene grafted with maleic anhydride, wherein about 1 to 2 molar proportions of (ii) and about 1 to 4 molar proportions of (iii) are used per molar proportion of maleic anhydride moiety.

9. The composition of claim 5 wherein (iii) is a hydrocarbyl substituted succinic acid or anhydride in which the hydrocarbyl substituent is an alkenyl or alkyl group derived from a polymer of $C_2$ to $C_5$ mono-olefin.

10. The composition of claim 9 wherein the carboxylic acid is polyisobutenyl succinic anhydride having about 50 to 400 carbon atoms in the polyisobutenyl group.

11. The composition of claim 5 wherein the amine is alkylene polyamine of the general formula $$H_2N\text{-}(\text{alkylene}\text{—}NH)_x\text{-}H$$

wherein x is about 1 t©10 and the alkylene radical is ethylene.

12. The composition of claim 5 which comprises the reaction product of 5 to 30 wt.% of the ethylene copolymer in 95 to 70 wt.% of a mineral lubricating oil, free radical grafted with maleic anhydride whereby both the copolymer and some oil have become reacted with maleic anhydride, then reacting with a mixture of diethylene triamine and polyisobutenyl succinic anhydride having 50 to 400 carbons in said polyisobutenyl substituent.

13. The composition of claim 5 which is the reaction product of 5 to 30 wt.% of ethylenepropylene copolymer in 95 to 70 wt.% mineral lubricating oil free radical grafted with maleic anhydride using a free radical peroxide initiator, and further reacted with an ashless dispersant reaction product of about 1 to 2 moles polyisobutenyl succinic anhydride having 50 to 400 carbons in said polyisobutenyl substituent with a molar proportion of diethylene triamine.

14. The composition of claim 13 which is finally treated with an alkyl benzene sulfonic acid having an average of about 24 carbons in said alkyl group.

15. The composition of claim 5 wherein 5 to 30 wt.% of ethylene-propylene copolymer in 95 to 70 wt.% mineral lubricating oil is free radical grafted with maleic anhydride using a peroxide initiator, and is then simultaneously reacted with diethylene triamine and polyisobutenyl succinic anhydride.

16. The composition of claim 1 wherein the thickener in (b) is present in an amount ranging from about 6 to about 12 wt.% and the copolymer in (c) is present in an amount ranging from about 0.1 to about 2 wt.%.

17. A grease composition comprising
(a) from about 50 to about 90 wt.% of a lubricating oil,
(b) from about 6 to about 12 wt.% of a thickener based on a lithium soap, a calcium soap, their complexes, or mixtures thereof, and
(c) from about 0.1 to about 2 wt.% of a copolymer that comprises the reaction product of
(i) an ethylene copolymer comprising from about 15 to about 90 wt.% ethylene and from about 10 to about 85 wt.% of one or more $C_3$ to $C_8$ alpha-olefin wherein the copolymer has a number average molecular weight ranging from about 5,000 to about 500,000 and is grafted with an ethylenically unsaturated carboxylic acid material containing at least one ethylenic bond and at least one carboxylic acid groups or anhydride groups;

(ii) an alkylene or oxyalkylene amine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups will be about 3 to 70; and, (iii) a long chain hydrocarbyl substituted succinic anhydride or acid having 50 to 400 carbon atoms.

18. The composition of claim 17 wherein the thickener is a lithium soap or a lithium complex soap based on an hydroxy fatty acid having from 12 to 24 carbon atoms.

19. The composition of claim 18 wherein the hydroxy fatty acid comprises an hydroxy stearic acid.

20. The composition of claim 19 wherein the hydroxy stearic acid comprises 12-hydroxy stearic acid.

21. The composition of claim 17 wherein the ethylene content is between about 30 to about 80 wt.%.

22. The composition of claim 21 wherein the number average molecular weight is between about 10,000 and about 300,000.

23. The composition of claim 22 wherein the number average molecular weight is between about 20,000 and about 175,000.

24. The composition of claim 17 wherein (i) comprises a copolymer containing from about 30 to about 80 wt.% ethylene and from about 20 to about 70 wt.% propylene, having a number average molecular weight in the range of about 10,000 to 200,000 grafted with maleic anhydride.

25. The composition of claim 24 wherein (i) comprises ethylene and propylene grafted with maleic anhydride, wherein about 1 to 2 molar proportions of (ii) and about 1 to 4 molar proportions of (iii) are used per molar proportion of maleic anhydride moiety.

26. The composition of claim 17 which is the reaction product of 5 to 30 wt.% of ethylene-propylene copolymer in 95 to 70 wt.% mineral lubricating oil free radical grafted with maleic anhydride using a free radical peroxide initiator, and further reacted with an ashless dispersant reaction product of about 1 to 2 moles polyisobutenyl succinic anhydride having 50 to 400 carbons in said polyisobutenyl substituent with a molar proportion of diethylene triamine.

27. The composition of claim 17 wherein 5 to 30 wt.% of ethylene-propylene copolymer in 95 to 70 wt.% mineral lubricating oil is free radical grafted with maleic anhydride using a peroxide initiator, and is then simultaneously reacted with diethylene triamine and polyisobutenyl succinic anhydride.

28. A method for increasing the water resistance of a grease composition containing (a) from above about 50 to about 90 wt.% of a lubricating oil, and (b) from about 1 to about 15 wt.% of a water insoluble thickener, which comprises adding to said composition from about 0.01 to about 4 wt.% of a copolymer comprising the reaction product of (i) an ethylene copolymer comprising from about 15 to about 90 wt.% ethylene and from about 10 to about 85 wt.% of one or more $C_3$ to $C_{28}$ alpha-olefin wherein the copolymer has a number average molecular weight ranging from about 5,000 to about 500,000 and is grafted with an ethylenically unsaturated carboxylic acid material containing at least one ethylenic bond and at least one carboxylic acid groups or anhydride groups;

(ii) an alkylene or oxyalkylene amine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups will be about 3 to 70; and (iii) a long chain hydrocarbyl substituted succinic anhydride or acid having 50 to 400 carbon atoms.

29. The method of claim 28 wherein the thickener is based on a lithium soap, a calcium soap, their complexes, or mixtures thereof.

30. The method of claim 29 wherein the thickener is a lithium soap or a lithium complex soap based on an hydroxy fatty acid.

31. The method of claim 30 wherein a pure hydrocarbon solvent, a mixed hydrocarbon solvent, a chlorohydrocarbon solvent, or mixtures thereof is added to the lubricating composition.

* * * * *